US007694960B2

(12) United States Patent
Sing

(10) Patent No.: US 7,694,960 B2
(45) Date of Patent: Apr. 13, 2010

(54) MEDIA SIZE SENSING SYSTEM AND METHOD

(75) Inventor: Samrin Sing, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/198,279

(22) Filed: Aug. 26, 2008

(65) Prior Publication Data

US 2010/0052246 A1 Mar. 4, 2010

(51) Int. Cl.
*B65H 1/00* (2006.01)

(52) U.S. Cl. ..... 271/171

(58) Field of Classification Search ..... 271/171; 399/389, 393

See application file for complete search history.

(56) References Cited

U.S. PATENT DOCUMENTS 3,061,303 A 10/1962 Glasser et al
4,607,834 A 8/1986 Dastin
4,697,803 A * 10/1987 Kan et al. ..... 271/127
4,786,042 A 11/1988 Stemmle
5,172,903 A 12/1992 Haneda et al.
5,333,852 A * 8/1994 Milillo et al. ..... 271/171
5,655,764 A 8/1997 Ota et al.
6,651,979 B2 11/2003 Shyu
6,688,592 B1 * 2/2004 Tan et al. ..... 271/171
6,985,265 B2 * 1/2006 Ito ..... 358/400
7,441,769 B2 * 10/2008 Miki ..... 271/171
2005/0196211 A1 9/2005 Miki
2006/0087072 A1 4/2006 Kwon et al.
2006/0087073 A1 * 4/2006 Yamagishi ..... 271/171

* cited by examiner

*Primary Examiner*—David H Bollinger

(57) ABSTRACT

A media size sensing system includes independently moveable length and width edge guides, in a media tray, for positioning against orthogonal edges of media sheets. A linearly sliding sensor device is provided, and a single linkage connects the length and width edge guides to the sensor device, the single linkage providing a unique position indication that is a function of both length and width for a range of media sheet sizes.

15 Claims, 9 Drawing Sheets

MEDIA SIZE SENSING SYSTEM AND METHOD

BACKGROUND

Media trays for imaging devices, such as printers and photocopiers, are typically configured to accommodate various sizes of print media (e.g. paper, cardstock, etc.). To this end, most media trays include a moveable length edge guide and a moveable width edge guide. The length and width edge guides hold the media in a neat stack in a constant location, so that the position and orientation of the media stays substantially constant as the imaging machine draws sheets into the imaging mechanism.

Systems have been developed to automatically detect the size of print media that is in the tray, and provide this information to the imaging device or a computer associated therewith. Automatic detection of media size helps prevent certain types of imaging errors, such as printing a document on the wrong size media, or printing in the wrong location on the media. In many cases, automatic media size sensing is achieved using two sets of sensors—one set of sensors associated with the length edge guide, and another set of sensors associated with the width edge guide. This approach tends to be costly, includes many parts, and can reduce reliability. Additionally, some automatic media size sensing systems can have difficulty distinguishing between two media sizes that are close in length and/or width.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
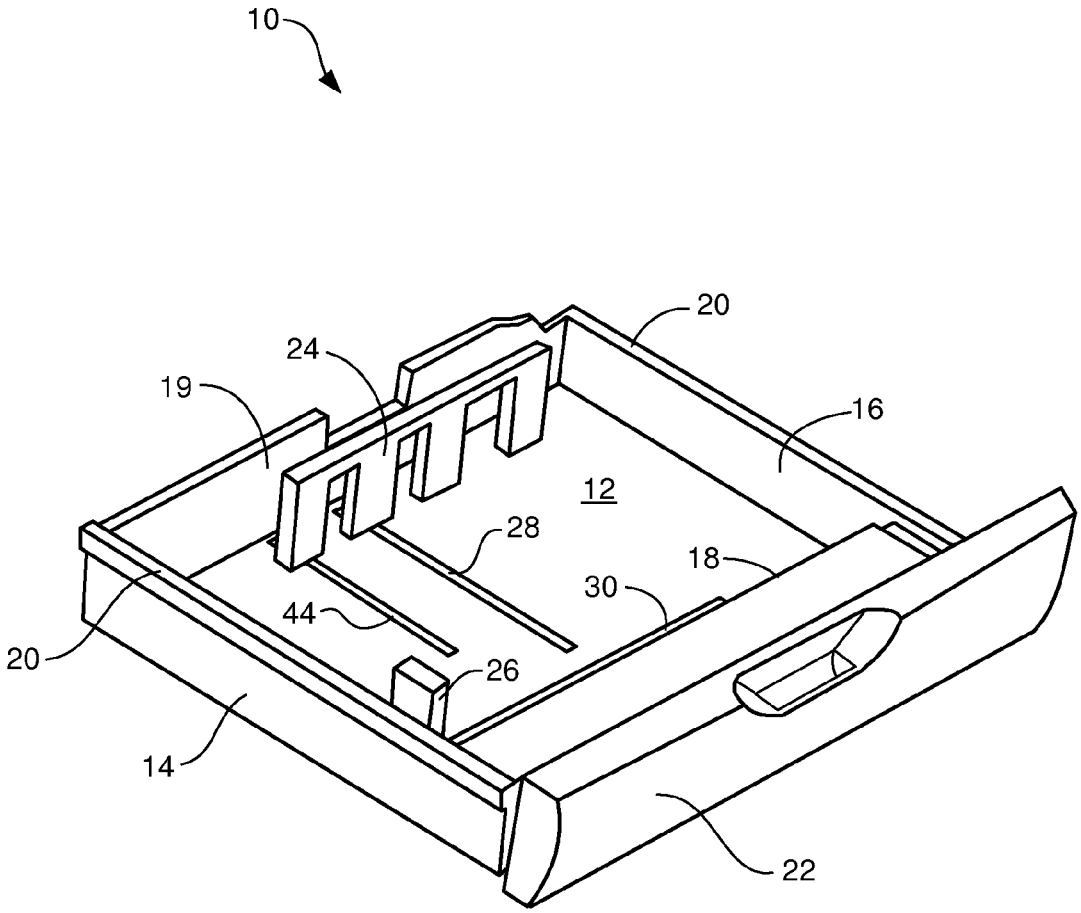
FIG. 1 is a top perspective view of an embodiment of a media tray having a media size sensing system in accordance with the present disclosure.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

An embodiment of a media tray 10 for holding sheets of media for an imaging device is shown in FIG. 1. This media tray generally comprises a body having a floor 12, side walls 14 and 16, a front wall 18, and a back wall 19. The tray can include sliding rails 20 on each side wall, to allow it to be slid into position in the imaging device, and a fascia panel 22 attached near the front wall. The fascia panel can be configured to match the contours and appearance of an outside surface of the imaging device (not shown) into which the media tray fits. The media tray embodiment shown in FIG. 1 is simplified for purposes of illustration. Various components that are frequently associated with a media tray, such as rollers, a latch mechanism, etc., are not shown, and many other details that are not relevant to the present discussion are not shown.

The media tray of FIG. 1 includes a moveable width edge guide 24 and a moveable length edge guide 26 which are configured to linearly slide in a width edge guide slot 28 and length edge guide slot 30, respectively, in the floor 12 of the media tray. The length edge guide slides in a direction generally parallel to the front wall 18 of the media tray, and the width edge guide slides in a direction generally parallel to the side walls 14, 16 of the media tray. The length and width edge guides thus slide in directions generally perpendicular to each other, so that when print media is placed into the tray one side edge of the stack of sheets (not shown) is placed against the front wall 18, and the width edge guide 24 is moved toward the front wall to contact the opposite side of the stack. Similarly, the top edge of the stack of sheets (not shown) is placed against the side of the tray 16 that is opposite the length edge guide 26, and the length edge guide is then moved to contact the bottom side of the stack.

As noted above, systems have been developed to automatically detect the size of print media using the moveable length and width edge guides in media trays, and provide this information to an imaging device or a computer associated therewith. However, automatic media size sensing is typically achieved using two sets of sensors—one set of sensors associated with the length edge guide, and another set of sensors associated with the width edge guide.

Figure 2:
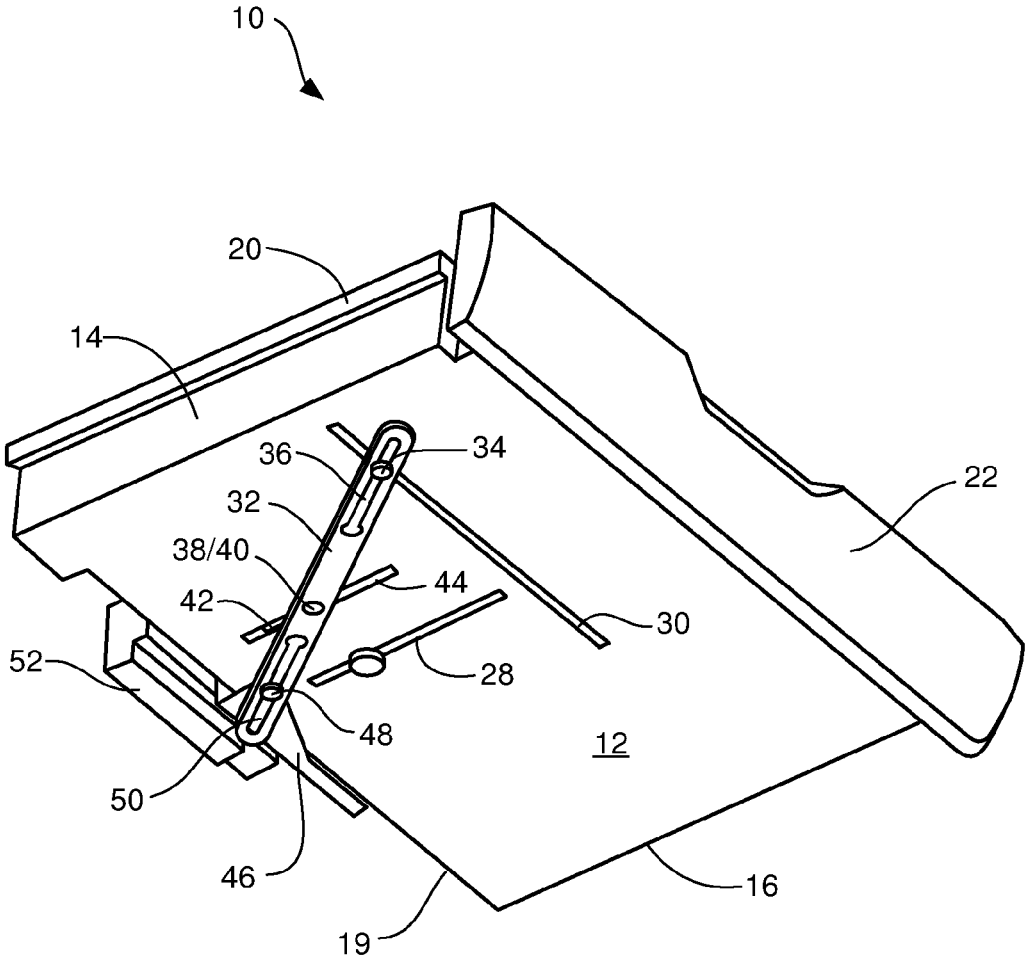
FIG. 2 is a bottom perspective view of the media tray of FIG. 1, showing a rotating/translating linkage and a size sense plate according to one exemplary embodiment.

Advantageously, a system and method for media size sensing has been developed that uses a single set of sensors. This system uses a single linkage that connects independently moving length and width guides of a media tray to provide a unique position indication that is a function of both length and width. A bottom perspective view of the media tray of FIG. 1 is shown in FIG. 2, in which many of the components of one embodiment of such a system are shown. In this view, the length edge guide slot 30 and width edge guide slot 28 are visible in the bottom 12 of the media tray 10. A single rotating/translating linkage bar 32 is connected to the length edge guide via a pivot pin 34 that extends through the bottom of the media tray. This pin is held in an elongate slot 36 of the linkage bar, so that the linkage bar can slide along the pin as the length edge guide slides.

The width edge guide is also attached to the linkage bar 32 by a pivot pin 38 that extends through the bottom of the media tray and is attached at a fixed pivot point 40 of the linkage bar. This pivot point is attached to a pivot tug 42 that slides in a pivot tug slot 44 that is parallel to the width edge guide slot 28. The pivot tug moves with the width edge guide throughout at least a portion of the range of motion of the width edge guide, thus moving the pivot point of the linkage bar. The distal end of the linkage bar 32 is attached to a size sense plate 46 via a sense plate pivot 48 that slides within a second elongate slot 50 of the linkage bar. The size sense plate is located behind the back wall 19, and is configured to linearly slide adjacent to a size sensor array 52 in a direction substantially parallel to the length edge guide slot 30. The size sensor array includes a group of sensors, such as optical sensors, that give different output depending upon the position of the size sense plate, as explained in more detail below.

By using a single linkage 32 between the length edge guide 26 and the size sense plate 46 and by using the width edge guide 24 to vary the pivot point 40 of the linkage bar, the single linkage connects independently moving length and width guides to provide a unique position for the size sense plate that is a function of both the length and width of the media. Size sensing is thus based on a geometric combination of the length and width edge guides, resulting in one set of sensors defining an overall media size, rather than, for example, two sets of sensors reporting individual lengths and widths. With this configuration a large variety of media sizes can be detected using relatively few sensors, potentially resulting in more reliability and lower cost for automatic media size sensing. This system also provides a strong ability to decipher between two sizes that are close in length and/or width.

Top views of a media tray 300 including an embodiment of this type of media size sensing system are shown in FIGS. 3-7. In these views a portion of the bottom 302 of the media tray is cut away to show the linkage bar 304 and related structure, which are located below the tray bottom, and would normally not be visible in a top view of the tray. The views in FIGS. 3-7 show the length and width edge guides 306, 308 in positions that would be used with various sizes of print media, and thereby demonstrate the corresponding positions of the other components of the media size sensing system.

Figure 3:
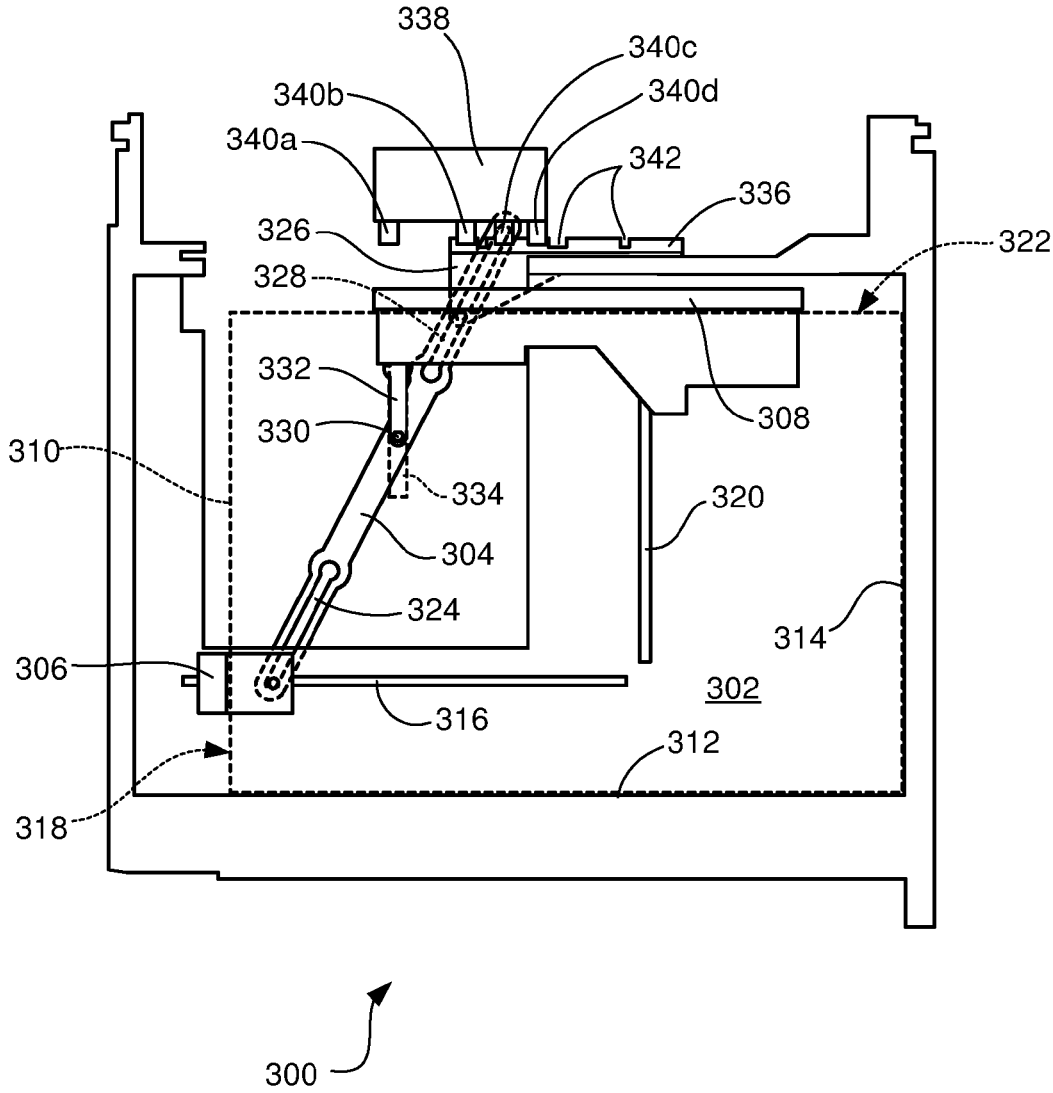
FIG. 3 is a top, partially broken-out view of an embodiment of a media tray like that of FIGS. 1 and 2, showing the rotating/translating linkage and sensor system with the length and width edge guides positioned for ledger size print media.

In the configuration of FIG. 3, the presumed print media, represented by the dashed outline 310, is of ledger size sheets, which would be placed in abutment with the front wall 312 and right side wall 314 of the media tray. With this size of print media, the length edge guide 306 is almost fully retracted in its slot 316 when placed against the bottom edge 318 of the print media, and the width edge guide 308 is also substantially retracted in its slot 320 when placed against the side edge 322 of the print media. The length edge guide 306 is pivotally attached through a first slot 324 at one end of the linkage bar 304. At the opposite end of the linkage bar, the size sense plate 326 is pivotally connected to the linkage bar through a second slot 328 of the linkage bar. Approximately at its midpoint, the linkage bar is attached at a pivot point 330 to the pivot tug 332. The pivot tug rides in a pivot tug slot 334, which runs generally parallel to the width edge guide slot 320.

The width edge guide 308 is releasably attached to the pivot tug 332, and causes the pivot tug to slide back and forth in the pivot tug slot 334 as the width edge guide moves. With the pivot point 330 of the linkage bar 304 and the attachment point of the length edge guide 306 configured to move with the length and width edge guides, the linkage bar moves as a function of both the length and width edge guide positions, thus moving the size sense plate 326 to a unique position for each combination of length and width edge guide positions. It is to be appreciated that the arrangement of the length and width edge guides with respect to the linkage bar and the sensor array can be configured differently than shown in the embodiment of FIGS. 3-7. For example, the orientation of the print media with respect to the tray can be rotated 90°, so that the positions of the length and width edge guides are swapped. Additionally, the pivot point can be attached to the length edge guide, rather than the width edge guide, with the width edge guide attached to the far end of the linkage bar. In such a configuration the sensor array can be positioned adjacent to a side of the media tray, rather than the back of the media tray. Those of skill in the art will recognize that other alternative arrangements can also be used.

The size sense plate 326 includes a rail 336 that moves linearly relative to the size sensor array 338. The size sensor array includes a series of sensors 340*a-d* that are configured to give a different signal depending upon the relative position of the rail. For example, the sensors 340 can be optical sensors, and the rail 336 can include a series of cutouts 342 that will allow a light beam of each optical sensor to pass through the respective cutout when the cutout is in the proper position. Otherwise, the rail will block the particular optical sensor.

Figure 8:
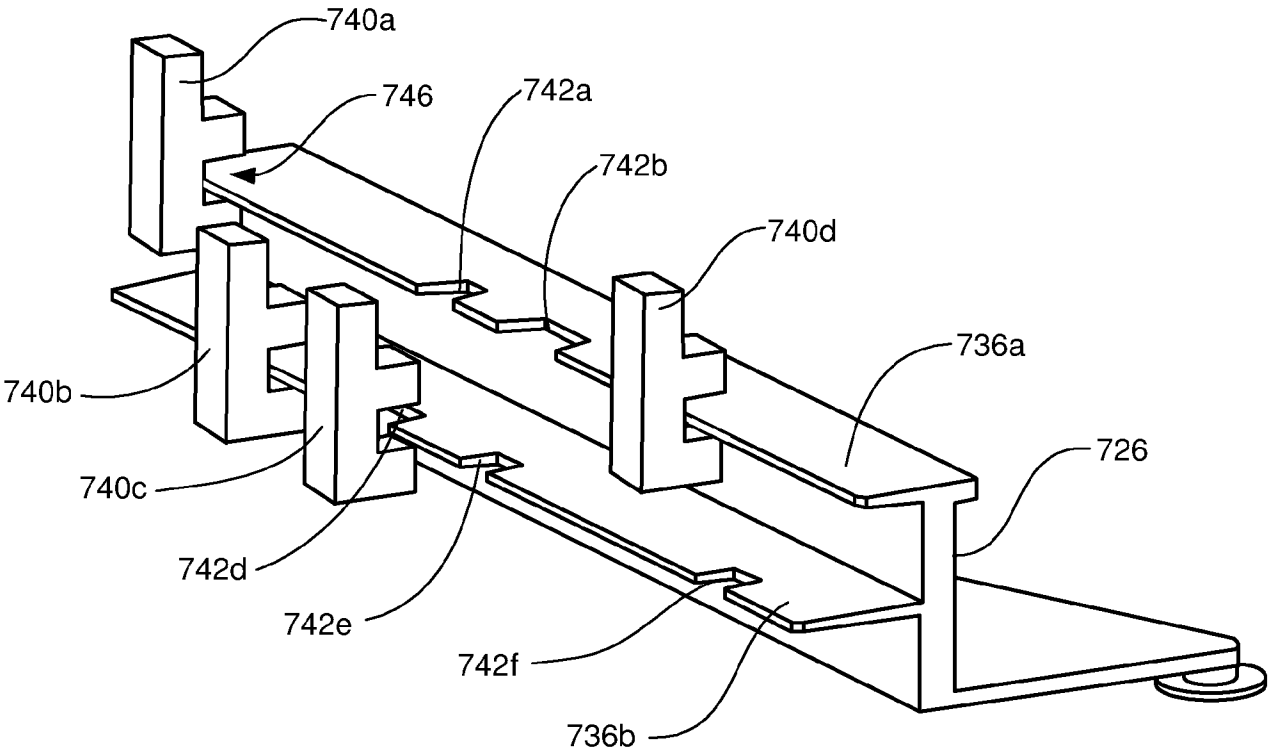
FIG. 8 is a perspective view of an embodiment of a sense plate and sensor array that can be associated with a media tray having a media size sensing system in accordance with the present disclosure, with the sense plate positioned to block several of the sensors.
Figure 9:
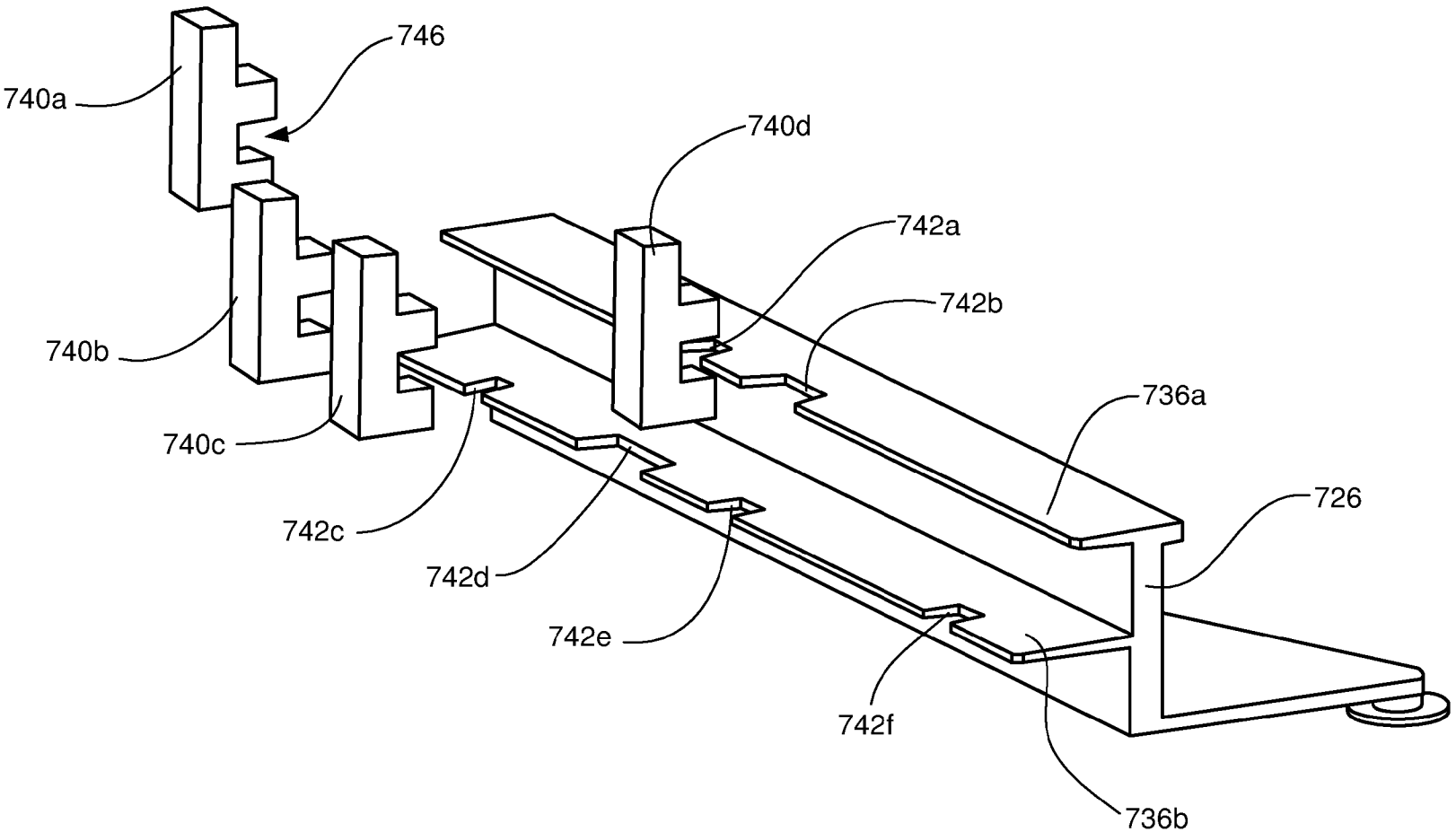
FIG. 9 is a perspective view of the sense plate and sensor array of FIG. 8, with the sense plate extended to a position to block just one of the sensors according to one exemplary embodiment.

Close-up perspective views of one embodiment of a size sense plate 726 and optical sensors 740 are shown in FIGS. 8-9. The sensors are labeled 740*a-d*, and in this embodiment are optical sensors. The size sense plate includes a top rail 736*a* and a bottom rail 736*b*, which each include cutouts 742*a-f*, two of which are in the upper rail 736*a*, and four of which are in the bottom rail 736*b*. Each sensor includes a slot 746 (only one of which is labeled in each of FIGS. 8 and 9) through which the rail of the size sense plate can pass. A part of the sensor on one side of the slot originates a beam of light (e.g. from an LED source) and the part of the sensor on the other side of the slot has an optical detector, such as a photodiode, which provides an electrical indication when the light is sensed. When the rail blocks the light, one electrical condition is created. When a cutout in the rail allows the light beam to pass, a different electrical condition is created.

In the position of FIG. 8, the size sense plate 726 is in a position in which the first sensor 740*a* is blocked by the top rail 736*a*, the second sensor 740*b* is blocked by the bottom rail 736*b*, the third sensor 740*c* is adjacent to a cutout 742*d* and so is not blocked, and the fourth sensor 740*d* is blocked by the upper rail 736*a*. In this condition, sensors 740*a, b* and *d* will provide one signal (e.g. an "off" signal) and sensor 740*c* will provide a different signal (e.g. an "on" signal). This combination of signals is due to the position of the size sense plate, and represents a particular media size that is produced by a unique combination of positions of the length and width edge guides.

Shown in FIG. 9, however, is a different position of the size sense plate 726. In this position, the size sense plate has been drawn forward, so that the top rail is moved entirely away from the first and second sensors 740*a, b*, so that these sensors are not blocked by the top or bottom rails 736*a, b*, the third sensor 740*c* is blocked by the bottom rail 736*b*, and the fourth sensor 740*d* is adjacent to a cutout 742*a* and so is not blocked by the upper rail 736*a*. In this condition, sensors 740*a, b* and *d* will provide an "on" signal and sensor 740*c* will provide an "off" signal. This combination of signals will represent a different media size that is produced by a different combination of positions of the length and width edge guides compared to the positions shown in FIG. 8.

By using four sensors with six cutouts on two different rails of the size sense plate, eleven different size sense plate positions can be detected, which allows this system to detect eleven different media sizes. It will be apparent, however, that this type of system can be configured to detect many additional media sizes. For example, adding more sensors, using more than two rails on the size sense plate, and making the rails of the size sense plate longer, with additional combinations of cutouts, are just some of many methods that can be used to make this sort of system capable of detecting additional media sizes.

Referring back to FIGS. 3-7, by using a solid link between the size sense plate 326 and the length edge guide and pivoting it based on the width edge guide position, unique geometric triangles are created for each individual media size, thus allowing for media sizes that are close in size to be easily recognized using a single set of size sensors. As the length edge guide 306 moves, the linkage bar 304 rotates about the pivot point 330 on the pivot tug 332. This creates a specific triangle associated with that position based on the length edge guide and width edge guide locations. As the width edge guide moves, the pivot point 330 moves, causing the size sense plate to move to account for the new pivot point, and another unique triangle is created. As a result, unique size sense plate locations can be observed based upon the combination of the length and width edge guide positions. Movement of the size sense plate 326 blocks or unblocks different combinations of sensors 340, creating a unique sensor condition for different media sizes.

Figure 4:
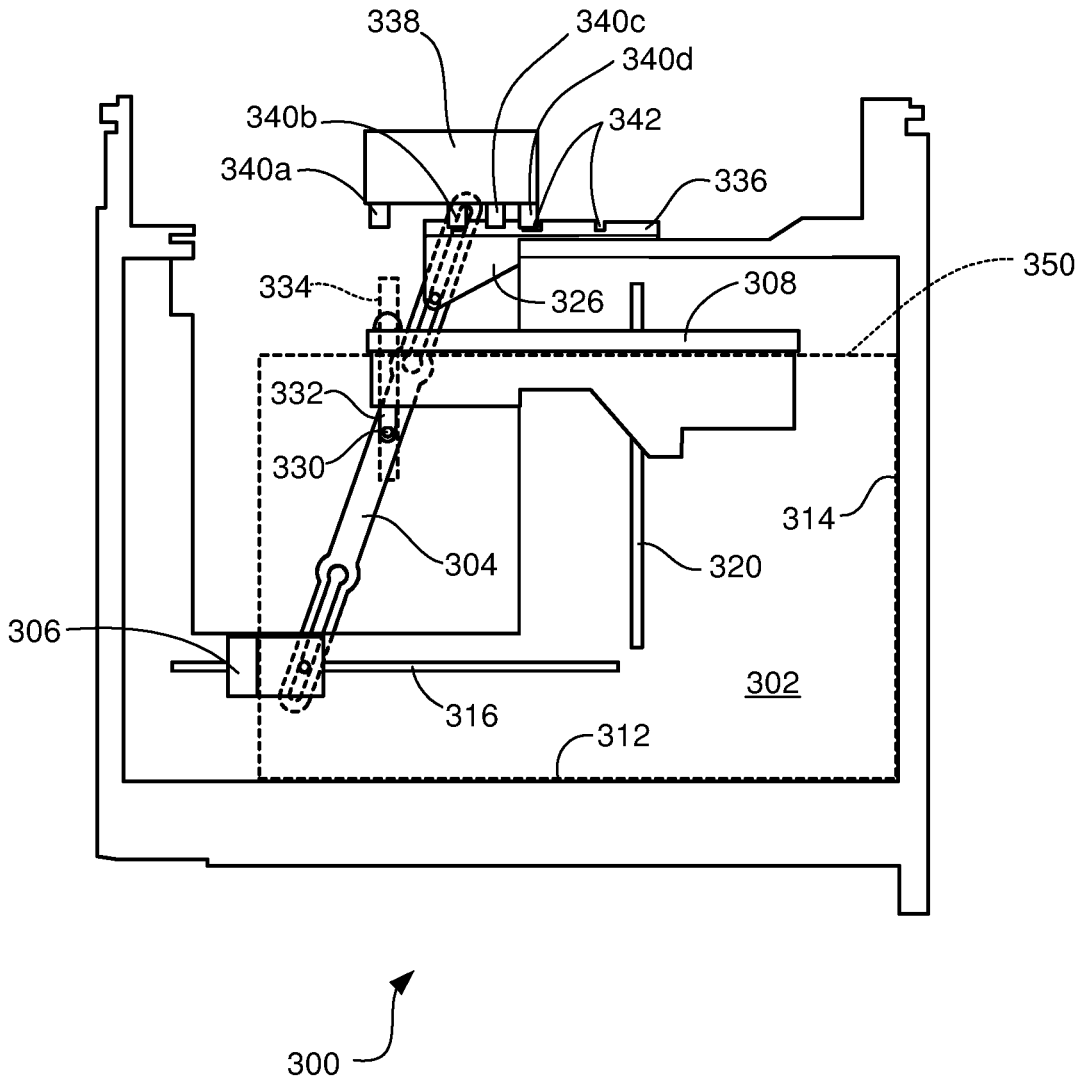
FIG. 4 is a top view of the media tray of FIG. 3, showing the length and width edge guides positioned for B4 size media according to one exemplary embodiment.

As noted above, the positions of the length and width edge guides 306, 308 in FIG. 3 correspond to ledger size media, denoted by the dashed outline 310. In this position, the size sense plate 326 is almost fully retracted to the right relative to the sensor array 338. Advantageously, the length and width edge guides are independently moveable, so that the media tray is not limited to media having lengths and widths that both always increase or decrease together. For example, shown in FIG. 4 is a top view of the media tray 300 of FIG. 3, showing the length and width edge guides positioned for B4 size (250 mm×353 mm) print media, the media sheets being represented by the dashed outline 350. In this configuration, the width edge guide 308 has been drawn down (compared to its position for ledger size media) against the side of the sheets of media, pulling the pivot tug 332 downwardly in the pivot tug slot 334. This moves the pivot point 330 of the linkage bar 304 downward, and thus tends to push the size sense plate 326 to the right in FIG. 4. As used herein, the terms "downward" and "upward", when used with respect to the width edge guide 308, the pivot tug 332 or the pivot point 330, have reference to the top and bottom of the drawing. Movement of these elements "downward" refers to motion toward the front wall 312 of the media tray, while "upward" movement is movement away from the front wall.

At the same time, the length edge guide 306 is brought into contact with the bottom edge of the media sheets 350, which pushes the bottom of the linkage bar 304 to the right (compared to its position for ledger size media), thus rotating the linkage bar about the pivot point 330 and tending to pull the size sense plate 326 to the left. With both the length and width edge guides in place against the sides of the media sheets, the size sense plate is placed in a unique position that blocks some of the sensors 340, and unblocks others of the sensors, thus providing a unique sensor indication for this size of media. The movement of the length and width edge guides causes the linkage to rotate and translate to a unique position that is a function of both the length and width of the media. Consequently, a unique geometric triangle is created for each individual media size, and thus a unique sense plate position is provided for each media size.

Figure 5:
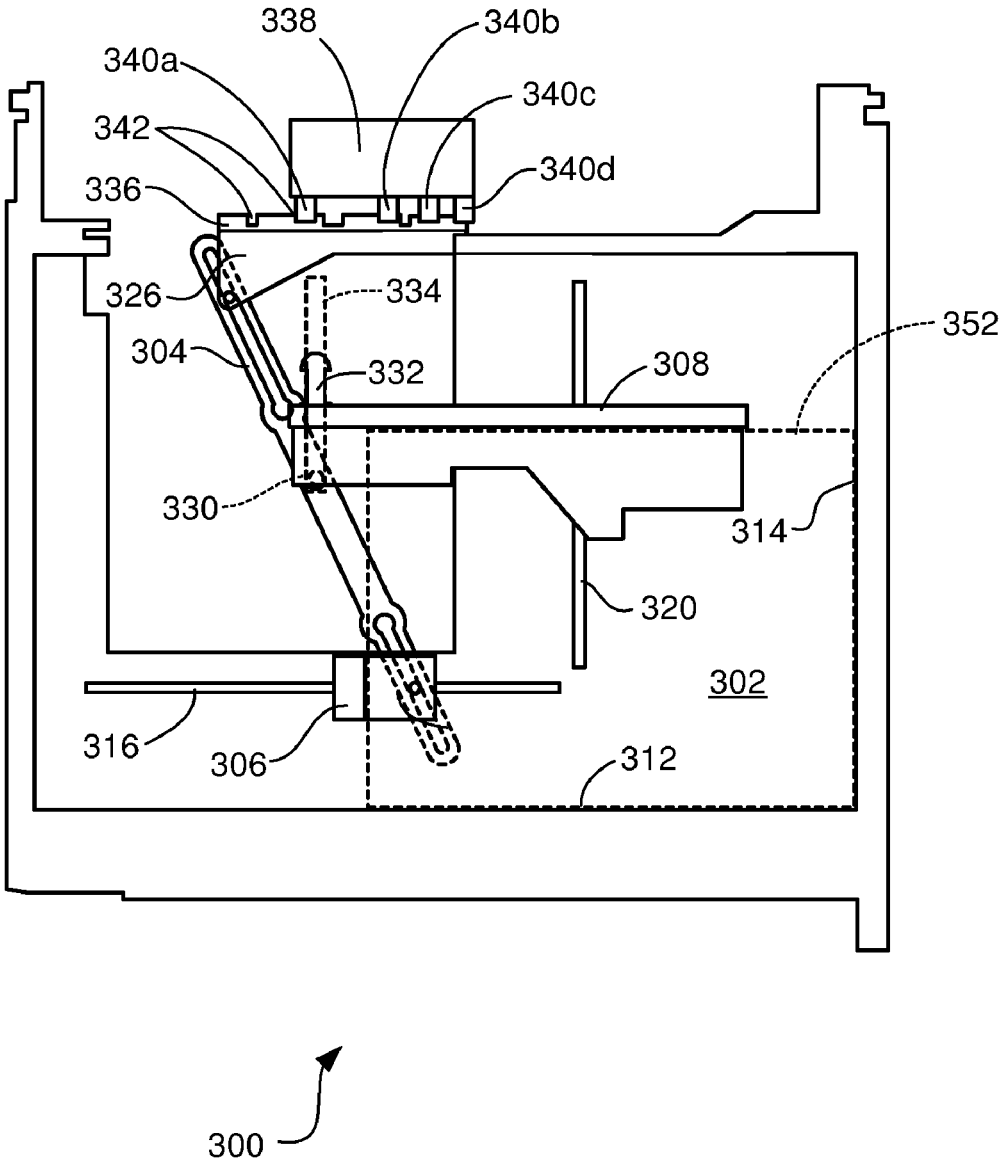
FIG. 5 is a top view of the media tray of FIG. 3, showing the length and width edge guides positioned for A4 size print media according to one exemplary embodiment.

While FIG. 5 shows a length and width edge guide and sense plate configuration for B4 print media, the same system can accommodate other smaller media sizes. Shown in FIG. 5 is a top view of the media tray 300 of FIG. 3, showing the length and width edge guides positioned for A4 size (210 mm×297 mm) print media, the media sheets being represented by the dashed outline 352. In this configuration, the width edge guide 308 has been drawn down against the side of the sheets of media, pulling the pivot tug 332 downwardly to the lower end of the pivot tug slot 334, and causing the width edge guide to detach from the pivot tug. This moves the pivot point 330 of the linkage bar 304 downward as far as it can go, and thus tends to push the size sense plate 326 to the right in FIG. 5.

With the pivot tug 332 detached from the width edge guide 308, the location of the pivot point 330 is determined by the end of the pivot tug slot 334, and the sensor position will be determined by position of the length edge guide. When the length edge guide 306 is brought into contact with the bottom edge of the media sheets 352, this pushes the bottom of the linkage bar 304 to the right, thus rotating the linkage bar about the pivot point 330 and tending to pull the size sense plate 326 to the left. This places the size sense plate in a unique position that blocks some of the sensors 340, and unblocks others of the sensors, thus providing a unique sensor indication for this size of media.

Figure 6:
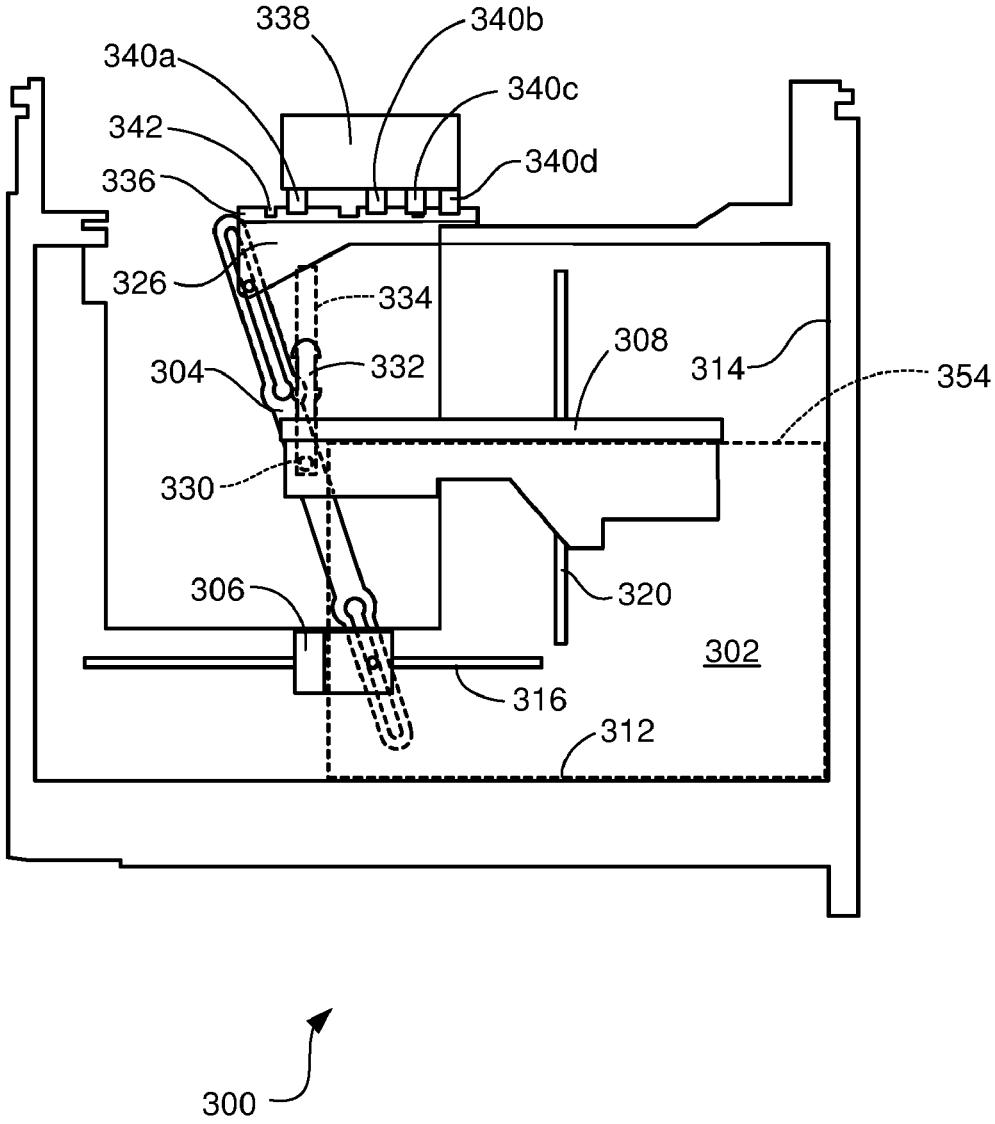
FIG. 6 is a top view of the media tray of FIG. 3, showing the length and width edge guides positioned for letter size print media according to one exemplary embodiment.

With the pivot tug 332 positioned against the bottom end of the pivot tug slot 334, this same system can accommodate media that is both wider and shorter while determining the media size based upon the position of the length edge guide 306. Shown in FIG. 6 is a top view of the media tray 300 with the length and width edge guides positioned for letter size (8½"×11") print media. Letter size media is not as long as A4 media, but is wider. Consequently, in this view it can be seen that the width edge guide 308, when placed against the side edge of the letter size print media, represented by the dashed outline 354, is in a position that is further upward compared to its position for the A4 media. Nevertheless, in this position the width edge guide is still detached from the pivot tug 332, and the pivot point 330 of the linkage bar 304 is in the same place as for A4 media.

Because the length edge guide 306 is brought further to the right, into contact with the bottom edge of the letter size media sheets 354, this pushes the bottom of the linkage bar 304 further to the right. This action rotates the linkage bar counter-clockwise about the pivot point 330 and pulls the size sense plate 326 further to the left. With the length edge guide in place against the bottom of the letter size sheets, the size sense plate is placed in a different unique position with respect to the sensors 340 than it occupied when the tray was loaded with A4 media, thus providing a unique sensor indication for this size of media. The relative positions of the size sense plate 726 and sensors 740 shown in FIG. 8 are intended to represent the positions for letter size media.

Figure 7:
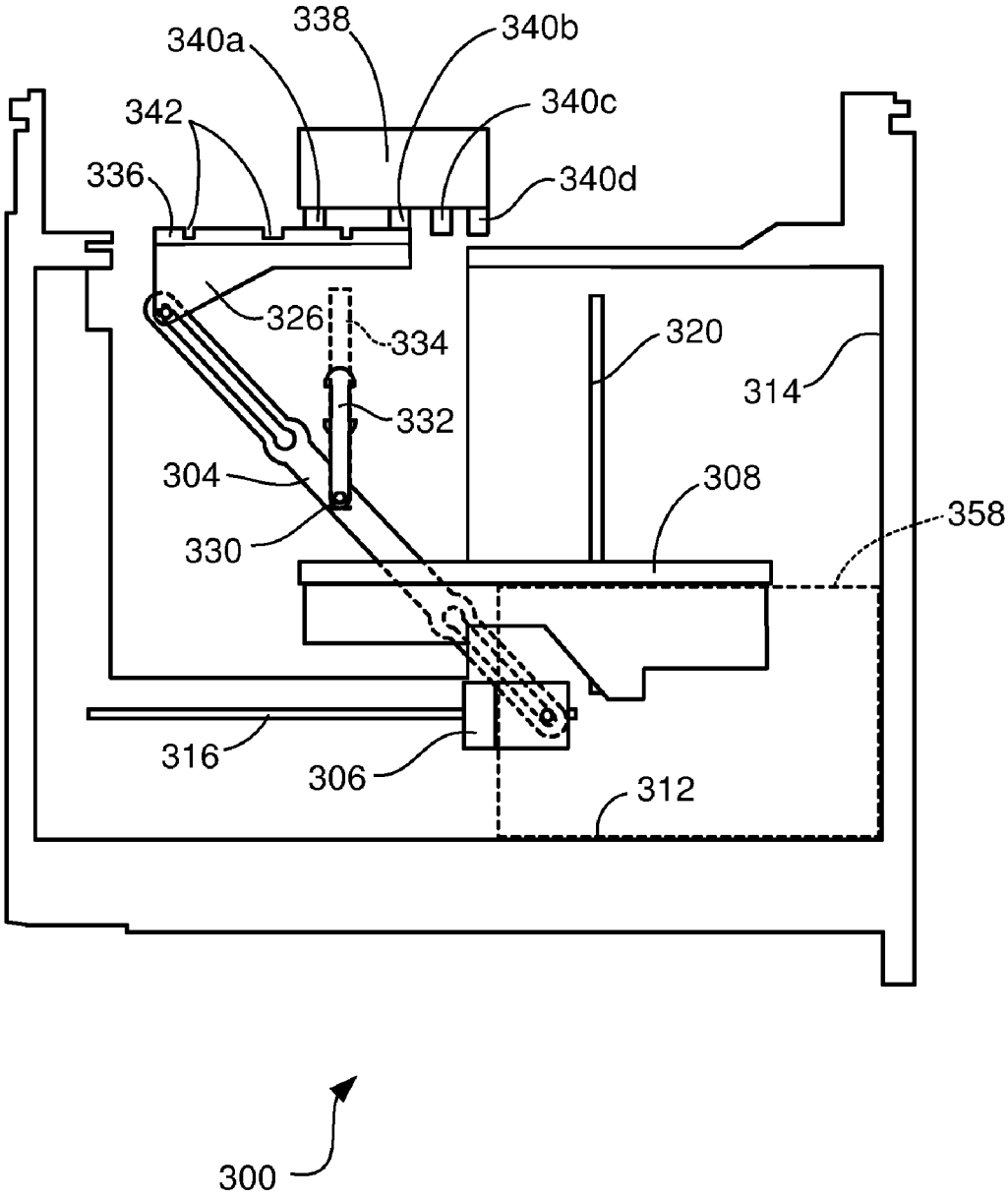
FIG. 7 is a top view of the media tray of FIG. 3, showing the length and width edge guides positioned for invoice size print media according to one exemplary embodiment.

Another aspect of the media size sensing system embodiment disclosed herein is illustrated in FIGS. 5-7. Because of the geometric relationship between the linkage bar 304 and the length and width edge guides 306, 308, the angle of the linkage bar tends to become more oblique with very small media. As media becomes narrower, the width edge guide 308 moves the pivot tug 332 and the pivot point 330 closer to the front wall 312 of the media tray. It will be apparent that, if the length edge guide 306 is also moved further to the right, for shorter media, the linkage bar 304 will rotate further and further counter-clockwise. As the angle of the linkage bar continues in this manner, the linear range of travel of the size sense plate increases, and a longer linkage bar would be used to reach the size sense plate 326.

As a practical matter, it has been recognized that it is desirable to impose limits on the length of the linkage bar and its maximum angle of rotation, as well as the linear range of travel of the size sense plate 326. For these reasons, as shown in FIGS. 5-7, the width edge guide 308 is removably connected to the pivot tug 332. At some point during its inward motion, toward the edge of narrower media, the pivot tug will contact the bottom end of the pivot tug slot 334. At this point the width edge guide can be detached from the pivot tug and continue to move toward the front wall 312 of the media tray to contact narrower and narrower media, where desired.

With the pivot tug 332 against the bottom end of the pivot tug slot 334, the pivot point 330 now becomes fixed. With a fixed pivot point, the angle of the linkage bar 304 and the corresponding position of the size sense plate 326 will be solely a function of the position of the length edge guide 306. The view of FIG. 7 shows the length and width edge guides positioned for statement size (5.5"×8.5") print media 358. This media is narrow enough that the width edge guide 308 is disconnected from the pivot tug 332, and the pivot point 330 is at the end of the pivot tug slot, 334, as far toward the front wall 312 of the media tray as possible. Given the length of the statement size sheets, the angle of the linkage bar pulls the size sense plate 326 very far to the left of the sensor array. The relative positions of the size sense plate 726 and sensors 740 shown in FIG. 9 are intended to represent the positions for statement size media.

It should be appreciated, however, that the arrangement shown herein for dealing with the range of angles of the linkage bar is only one possible embodiment. Other approaches are also possible. For example, the media tray can provide more restrictive limits on the range of travel of the length and/or width edge guides (i.e., having a more restrictive range of suitable media sizes), thus limiting the range of motion of the linkage bar. With this approach, the pivot point could be permanently (rather than removably) attached to the width edge guide, so that the pivot point always varies with the width of the media. Additionally, or alternatively, the length of the sensor array can be extended to accommodate very oblique angles of the linkage bar. Other variations can also be used while providing the same basic elements and functionality of the media size sensing system disclosed herein.

Referring back to FIGS. 3 and 4, when wider media (e.g. wider than letter size) is to be installed into the media tray 300, the width edge guide 308 can be moved away from the front wall 312, and reconnected with the pivot tug 332. As the width edge guide continues to move in this direction, it pulls the pivot tug, thus moving the pivot point 330 in the same direction. In one embodiment, the position at which inward motion of the pivot tug 332 stops, allowing the width edge guide 308 to be disconnected from the pivot tug so that the pivot point becomes fixed and the angle of the linkage bar is then varied by motion of the length edge guide 306 alone, is selected to correspond to media narrower than B4 size (250 mm×353 mm, about 9.8"×13.9") media. For wider media the position of the pivot point depends upon the location of the width edge guide. For narrower media, the pivot point will be determined by the end of the pivot tug slot 334, and will not change.

With a single rotating and translating linkage that is pivotally connected between both the length edge guide and the width edge guide in a media tray, many different media sizes can be detected with a single set of sensors. Considering the sensor array as a binary device, a blocked sensor can be considered to report a "0", while an unblocked sensor reports a "1". Taking this approach, provided in the following table are the sensor output combinations that can be obtained in one embodiment for five representative media sizes where the sensors and size sense plate are configured in the manner shown in FIGS. 8-9:

| Media Size | Sensor 1 | Sensor 2 | Sensor 3 | Sensor 4 |
|---|---|---|---|---|
| Ledger | 1 | 1 | 0 | 0 |
| B4 | 1 | 1 | 0 | 1 |
| A4 | 0 | 0 | 1 | 0 |
| Letter | 0 | 1 | 0 | 0 |
| Statement | 1 | 0 | 1 | 1 |

This table shows how four sensors can give a large number of different output combinations, allowing one relatively small set of sensors to detect many different media sizes. As noted above, the sensor and size sense plate configuration shown herein can detect up to 16 different media sizes. It will be apparent that more sensors and a different arrangement of cutout positions on the size sense plate can be used to detect an even greater variety of media sizes.

This media size sensing system thus provides a single rotating and translating linkage that connects independently moving length and width edge guides of a media tray to provide a unique position indication that is a function of both length and width. The linearly sliding size sense plate slides relative to a group of size sensors (e.g. optical sensors). Depending upon the relative positions of the length edge guide and width edge guide, the linkage will rotate to different angles, creating a unique geometric triangle for each individual media size, and thus a unique sense plate position for each media size. As the length and/or width edge guides move, the linkage is rotated about a sliding pivot point that causes the size sense plate to move a specific distance. For narrow media, the pivot point can come to a fixed position, allowing the size sense plate position to be a function the length edge guide position alone.

Using this method, the size sensing is based on a geometric positional combination of the length and width edge guides, resulting in one set of sensors defining an overall media size, as opposed to two sets of sensors reporting individual lengths and widths. This system is economical and reliable because it includes relatively few parts, and it provides accurate size sensing of medias close in size, since size is based on the triangle created by the length and width edge guides, as opposed to independent length and width measurements.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A media size sensing system, comprising:

independently moveable length and width edge guides, in a media tray, for positioning against orthogonal edges of media sheets;

a linearly sliding sensor device; and a single linkage, connecting the length and width edge guides to the sensor device, the single linkage providing a unique position indication that is a function of both length and width for a range of media sheet sizes.

2. A system in accordance with claim 1, further comprising a sliding pivot, attached to the single linkage, whereby a pivot point of the single linkage is moveable.

3. A system in accordance with claim 2, wherein the sliding pivot is configured to slide in a direction parallel to a sliding direction of the width edge guide.

4. A system in accordance with claim 2, wherein the width edge guide is attached to the sliding pivot, whereby the pivot point of the single linkage changes as a function of a position of the width edge guide for the range of media sheet sizes.

5. A system in accordance with claim 4, wherein the width edge guide is releasable from the pivot for sheets that are narrower than the range of media sheet sizes, whereby the pivot point becomes substantially fixed and the position indication is solely a function of a position of the length edge guide for the narrower sheets.

6. A system in accordance with claim 1, wherein the sensor device comprises a sense plate, attached to the single linkage, configured to linearly slide adjacent to a sensor array, whereby a media size is determined by sensing a position of the sense plate adjacent to the sensor array.

7. A system in accordance with claim 6, wherein the sensor array comprises a plurality of optical sensors, and the sense plate comprises a rail having a plurality of cutouts, whereby the optical sensors are blocked by the rail or unblocked by the cutouts, depending upon a position of the sense plate.

8. A system in accordance with claim 1, wherein the sensor device is configured to detect at least eleven different media sizes based upon respective positions of the single linkage.

9. A printing system, comprising:

a media tray for holding sheets of print media;

independently moveable length and width edge guides, in the media tray, for positioning against orthogonal edges of media sheets in the tray;

a single linkage, connected to the length and width edge guides; and a sensor device, configured to provide a media size signal depending upon a position of a distal end of the single linkage for a range of media sheet sizes.

10. A system in accordance with claim 9, further comprising a sliding pivot, attached to the single linkage, configured to move with the width edge guide, whereby a pivot point of the single linkage moves with the width edge guide.

11. A system in accordance with claim 10, wherein the width edge guide is releasable from the sliding pivot, thereby substantially fixing the pivot point, for media sheets that are narrower than the range of media sheet sizes.

12. A method for detecting a size of print media in a media tray, comprising the steps of:

sliding a first edge guide against a first edge of print media in the media tray, the first edge guide being attached to a sliding pivot of a linkage; and sliding a second edge guide against a second orthogonal edge of the print media, the second edge guide being attached to a proximal end of the linkage, thereby pivoting the linkage and linearly moving a distal end thereof adjacent to a media size sensor.

13. A method in accordance with claim 12, further comprising the steps of:

detaching the first edge guide from the sliding pivot with the sliding pivot at an end of its range of motion; and moving the first edge guide to contact the first edge of the print media outside the range of motion of the sliding pivot, whereby a position of the distal end of the linkage is solely a function of the position of the second edge guide.

14. A method in accordance with claim 12, wherein the step of sliding the first edge guide against the first edge of the print media comprises sliding a width edge guide against a side edge of the print media, and the step of sliding the second edge guide against the second edge of the print media comprises sliding a length edge guide against a top or bottom edge of the print media.

15. A method in accordance with claim 12, wherein the step of sliding the second edge guide and thereby pivoting the linkage and moving a distal end thereof adjacent to a media size sensor comprises:

pivoting the linkage to cause a sliding sense plate attached to the distal end thereof to move adjacent to a sensor array; and detecting the size of the print media based upon a position of the size sense plate relative to the sensor array.

* * * * *